US006564027B2

(12) United States Patent
Haraguchi et al.

(10) Patent No.: US 6,564,027 B2
(45) Date of Patent: May 13, 2003

(54) IMAGE FORMING APPARATUS

(75) Inventors: Manami Haraguchi, Kanagawa (JP); Katsuhiro Sakaizawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/897,928

(22) Filed: Jul. 5, 2001

(65) Prior Publication Data

US 2002/0015600 A1 Feb. 7, 2002

(30) Foreign Application Priority Data

Jul. 6, 2000 (JP) ..... 2000-204468

(51) Int. Cl.[7] ..... G03G 15/02; G03G 15/08

(52) U.S. Cl. ..... 399/174; 399/285

(58) Field of Search ..... 399/149, 150, 399/174, 175, 176, 265, 267, 270, 279, 285, 286

(56) References Cited

U.S. PATENT DOCUMENTS 5,179,414 A * 1/1993 Bhagat ..... 399/270 X
5,255,057 A * 10/1993 Stelter et al. ..... 399/285
5,519,472 A 5/1996 Ojima et al.
5,585,894 A * 12/1996 Araya et al. ..... 399/176 X
5,666,192 A * 9/1997 Mashimo et al. ..... 399/174
5,890,037 A * 3/1999 Kukimoto et al. ..... 399/175
6,002,900 A * 12/1999 Ishiyama ..... 399/149
6,173,144 B1 * 1/2001 Hirabayashi et al. ... 399/149 X

FOREIGN PATENT DOCUMENTS

JP 2000-081771 * 3/2000

* cited by examiner

*Primary Examiner*—Sandra Brase
(74) *Attorney, Agent, or Firm*—Fitzpatrick, Cella, Harper & Scinto

(57) ABSTRACT

An image forming apparatus includes an image bearing member and an electrostatic image forming device, which is adapted to form an electrostatic image on the image bearing member, and which includes an electrifying member contacted with the image bearing member to electrify the image bearing member. The electrifying member includes a first conductive member to which voltage is applied, and a developer carrying member cooperating with the image bearing member to form a nip therebetween and is adapted to carry developer to the nip and to develop the electrostatic image with the developer. The electrifying member also includes a second conductive member to which a voltage is applied. A resistance value between the second conductive member and a developer layer of the developer carried on the developer carrying member is greater than a resistance value between the first conductive member and a surface of the image bearing member.

17 Claims, 3 Drawing Sheets

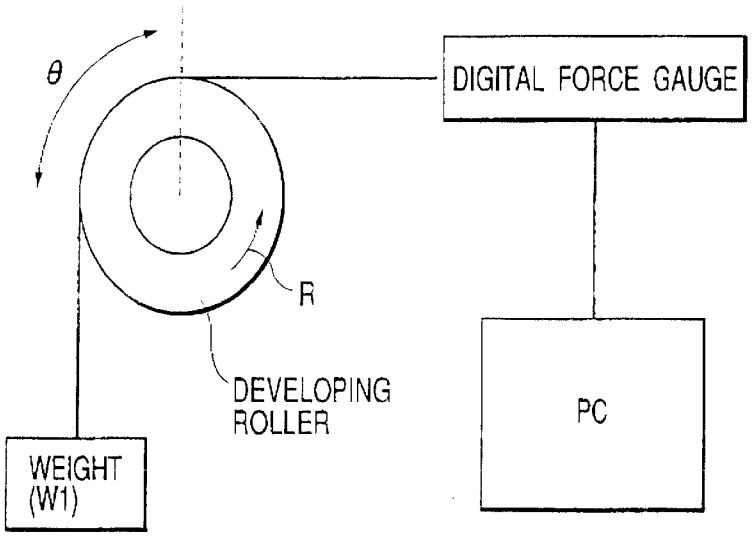

FIG. 3

FIG. 4

| DEVELOPING NIP RESISTANCE VALUE \ ELECTROSTATIC CHARGE NIP RESISTANCE VALUE | $1\times10^{3}(\Omega)$ | $1\times10^{4}(\Omega)$ | $1\times10^{5}(\Omega)$ | $1\times10^{6}(\Omega)$ | $1\times10^{7}(\Omega)$ |
|---|---|---|---|---|---|
| $1\times10^{5}(\Omega)$ | ▲ | ▲ | △▲ | △▲ | △▲ |
| $1\times10^{6}(\Omega)$ | ▲ | ▲ | △▲ | △▲ | △▲ |
| $1\times10^{7}(\Omega)$ | ◎ | ◎ | ◎ | △ | △ |
| $1\times10^{8}(\Omega)$ | ◎ | ◎ | ◎ | △ | △ |
| $1\times10^{10}(\Omega)$ | ◎ | ◎ | ◎ | △ | △ |

AT IMPRESSION OF −350V

AT IMPRESSION OF −600V

△ POOR ELECTROSTATIC CHARGE
▲ RE-CHARGE AT DEVELOPING NIP
◎ GOOD

IMAGE FORMING APPARATUS

BACKGROUND OF THE INVENTION

1. Field of the Invention

The present invention relates to an image forming apparatus such as a copying machine, a printer and the like, utilizing an electrophotographic or electrostatic recording system.

2. Description of the Related Art

In conventional image forming apparatuses, such as copying machines, printers and the like, a latent image formed on an image bearing member comprised of an electrophotographic photosensitive body or an electrostatic recording dielectric body is visualized by using toner as developer, which is powder. Recently, in order to cope with compactness, simplification, energy reduction and environmental problems, an image forming apparatus in which a cleaning container or a waste toner container is omitted or in which generation of ozone due to discharging is reduced has been noticed.

Now, as an example, a cleanerless image forming apparatus of a reversal developing system with nonmagnetic negatively electrified toner using noncontact developing and noncontact electrifying type will be described with reference to FIG. 6.

FIG. 6 is a sectional view showing a schematic construction of a conventional image forming apparatus using dry type one-component developing apparatus.

As shown in FIG. 6, such an image forming apparatus comprises a photosensitive drum 101 as a latent image bearing member rotated in a direction shown by the arrow p, an electrifier 102, an exposing device 103 for supplying image information, a developing device 104, a transferring device 105 as transferring means and a fixing device 106.

The developing device 104 includes a developing roller 110 as a developer carrying member rotated in a direction shown by the arrow q to carry toner as developer to an opposed area between the photosensitive drum 101 and the developing roller. The developing roller 110 is a rigid body having conductivity, and a gap between the developing roller and the photosensitive drum 101 is selected to be about 300 μm. Further, around the developing roller 110, there are provided a peeling roller 111 rotated in a direction shown by the arrow r and serving to supply nonmagnetic one-component toner onto the developing roller 110 and to peel the toner from the developing roller 110, a regulating blade 112 for applying desired electrifying amount to the toner on the developing roller 110 and for regulating a toner amount, and a developing bias voltage power source 113 for applying developing bias obtained by overlapping an AC voltage and a DC voltage to the developing roller 110. In this example, a DC voltage of −350 V and rectangular waveform AC voltage having a frequency of 1800 Hz and peak-to-peak voltage of 1600 V are applied to the developing roller 110 from the developing bias voltage power source 113. Further, the peeling roller 111 is constituted by forming a foam sponge around a metallic core support shaft.

The electrifier 102 includes an electrifying roller 120 as electrifying means rotated in a direction shown by the arrow s and having a conductive metal core (not shown) and a conductive elastic layer (not shown) covering the metal core, and an electrifying bias voltage power source 121 for applying a DC developing bias voltage to the electrifying roller 120. In this example, a DC voltage of −600 V is applied to the electrifying roller 120 from the electrifying bias voltage power source 121. The electrifying roller 120 is contacted with the photosensitive drum 101 and is rotated with peripheral speed difference with respect to the photosensitive drum. In this example, by using the photosensitive drum having a charge injecting layer on the surface thereof and the electrifying roller having low resistance, the photosensitive drum can be electrified with potential substantially the same as the electrifying bias voltage without discharging.

As shown in FIG. 6, the photosensitive drum 101 is rotated in the direction p and is uniformly charged to −600 V on the surface thereof by the electrifying roller 120, and, thereafter, an electrostatic latent image is formed on the photosensitive drum 101 by the exposing device 103. The electrostatic latent image is visualized as a toner image by the toner carried by the developing roller 110 opposed to and contacted with the photosensitive drum 101 from the developing device 104. Thereafter, the toner image on the photosensitive drum 101 is transferred onto a transfer material 107 as a recording medium such as paper or OHP sheet by the transferring device 105. Then, by the fixing device 106, the toner image is dissolved and ultimately fixed onto the transfer material 107.

On the other hand, after the transferring, residual toner (referred to as "transfer-residual toner" hereinafter) remaining on the photosensitive drum 101 is often electrified with weak positive polarity because it is subjected to the transferring bias voltage. When the transfer-residual toner reaches an abut area (referred to as "electrostatic charge nip" or "electrifying nip" hereinafter) between the electrifying roller 120 and the photosensitive drum 101, the transfer-residual toner is returned to negative polarity while being subjected to friction and agitating and is carried to a developing station by the rotation of the photosensitive drum 101. The toner carried to the developing station is collected on the developing roller simultaneously with the developing and is used again for visualizing a new electrostatic latent image.

However, in the above-mentioned conventional image forming apparatus, there may arise the following problem during image formation.

In such an image forming apparatus, at the developing station, an electric field for biasing the toner from the photosensitive drum to the developing roller with respect to an image portion and a nonimage portion on the photosensitive drum and an electric field for biasing the toner from the developing roller to the photosensitive drum with respect to the image portion and the nonimage portion on the photosensitive drum are in generated alternately. When the electric field for biasing the toner from the developing roller to the photosensitive drum is being applied to the developing roller, after the electrostatic latent image on the photosensitive drum passes the developing area, the toner will also be adhered to the nonimage portion. Consequently, during the transferring, a portion of the transfer material corresponding to the nonimage portion is contaminated by the toner, with the result that a high quality image output cannot be attained.

Further, when the negatively electrified toner passed through the electrifying nip is collected at the developing station, since the electric field for biasing the toner from the developing roller to the photosensitive drum is generated, the toner cannot be collected completely.

To solve the above problem, it is considered that a developing method is improved as a contact developing system in which an elastic developing roller to which only DC voltage is applied is contacted with the photosensitive drum. In this case, DC voltage of −350 V is applied to the developing roller.

As a result, since the electric field for biasing the toner from the developing roller to the photosensitive drum is always generated with respect to the image portion on the photosensitive drum and the electric field for biasing the toner from the photosensitive drum to the developing roller is always generated with respect to the nonimage portion on the photosensitive drum, the toner is not adhered to the nonimage portion, thereby achieving a high quality image output.

Further, when the toner passed through the electrifying nip is collected at the developing station, since the electric field for biasing the toner from the photosensitive drum to the developing roller is always generated, the toner can be collected completely.

However, at a contact area (referred to as "developing nip" hereinafter) between the developing roller and the photosensitive drum, the latent image formed by the exposing portion may be distorted. Such a phenomenon occurs due to the fact that the electrifying process is effected not only by the electrifying roller but also by the developing roller contacted with the photosensitive drum.

SUMMARY OF THE INVENTION

An object of the present invention is to provide an image forming apparatus in which an image bearing member is prevented from being electrified by a developer carrying member.

Another object of the present invention is to provide an image forming apparatus in which an electrostatic image on an image bearing member is prevented from being distorted by a developer carrying member.

A further object of the present invention is to provide an image forming apparatus in which an image bearing member is electrified effectively by an electrifying member.

A still further object of the present invention is to provide an image forming apparatus in which a developer carrying member can perform a developing operation and a cleaning operation simultaneously.

The other objects and features of the present invention will be apparent from the following detailed explanation of the invention referring to the accompanying drawings.

BRIEF DESCRIPTION OF THE DRAWINGS

FIG. 3 is a schematic view showing a tool for measuring dynamic coefficient of friction of a developer carrying member of the image forming apparatus of FIG. 1;

FIG. 4 is a table for showing a relationship of a resistance value between a metal core of an electrifying member and the latent image bearing member and a resistance value between a metal core of the developer carrying member and the latent image bearing member in a comparative example regarding the first embodiment of the present invention;

DETAILED DESCRIPTION OF THE PREFERRED EMBODIMENTS

The present invention will now be explained in connection with embodiments thereof with reference to the accompanying drawings.

First Embodiment

First of all, a first embodiment of the present invention will be described.

Figure 1:
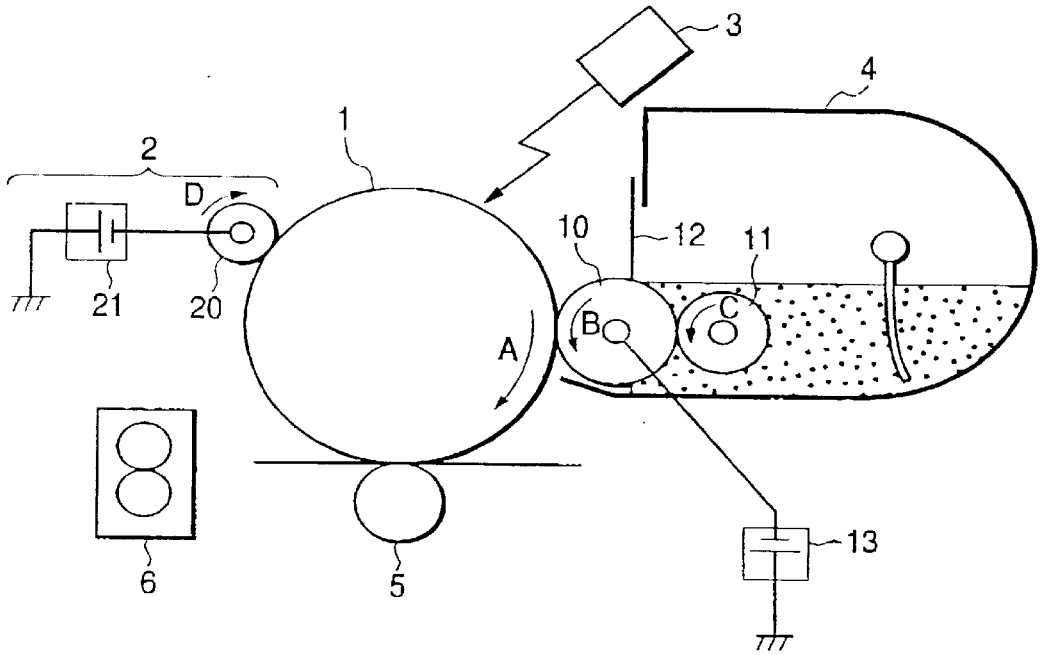
FIG. 1 is a sectional view showing a schematic construction of an image forming apparatus according to a first embodiment of the present invention.

FIG. 1 is a sectional view showing a schematic constriction of an image forming apparatus according to the first embodiment of the present invention. Such an image forming apparatus is of reversal developing type in which an image is visualized by adhering toner as developer to an image portion of a photosensitive drum as a latent image bearing member and is an image forming apparatus of contact electrifying and one-component contact developing type.

As shown in FIG. 1, the image forming apparatus includes a photosensitive drum 1 as a latent image bearing member rotated at a peripheral speed of 100 mm/sec in a direction shown by the arrow A, and, around the photosensitive drum 1, along a rotational direction thereof, there are provided, in order, an electrifier 2, an exposing device 3, a developing device 4, a transferring device 5, and a fixing device 6.

Next, a detailed operation of the image forming apparatus and various elements of the apparatus will be explained.

The electrifier 2 includes an elastic foam electrifying roller 20 as an electrifying member contacted with the photosensitive drum 1, and a DC high voltage power source 21 for applying electrifying bias voltage to a metal core as a conductive member of the electrifying roller 20. The electrifying roller 20 abut against the photosensitive drum 1 with total pressure of 1 kg and is rotatingly driven at a speed of 150 mm/sec in a direction (shown by the arrow D) opposite to a rotational direction of the photosensitive drum 1 at an abut area.

In the illustrated embodiment, first of all, when voltage of −600 V is applied to the electrifying roller 20 from the DC high voltage power source 21, a surface of the photosensitive drum 1 is uniformly electrified to −600 V without discharging.

Then, a laser beam corresponding to image information from the exposing device 3 is illuminated onto the uniformly electrified surface of the photosensitive drum 1, thereby forming an electrostatic latent image. A non-laser illumination area on the surface of the photosensitive drum 1 corresponds to a nonimage portion, and a laser illumination area corresponds to an image portion. A potential of the nonimage portion is −600 V and a potential of the image portion is −150 V.

The developing device 4 has an opening portion extending in a longitudinal direction, and an elastic developing roller 10 as a developer carrying member contacted with the photosensitive drum 1 and rotated at a speed of 150 mm/sec in a direction shown by the arrow B is disposed within the opening portion. The developing device further includes a stripping roller or peeling roller 11 (rotated in a direction shown by the arrow C) contacted with the elastic developing roller 10, and a metallic regulating blade 12 contacted with the elastic developing roller 10 and disposed above the peeling roller 11 in a vertical direction, and nonmagnetic toner as nonmagnetic one-component developer is housed in the developing device 4 having these elements. Further, outside of the developing device 4, there is provided a developing bias voltage power source 13 as a DC high voltage power source for applying developing bias to a metal core as a conductive member of the elastic developing roller 10.

In the developing device 4, the peeling roller 11 is rotated in the direction C to carry the toner onto a surface of the elastic developing roller 10 rotated in the direction B. When the toner carried by the elastic developing roller 10 is being passed between the elastic developing roller 10 and the regulating blade 12 urged against the elastic developing roller 10, the toner is negatively electrified by friction between the toner and the regulating blade 12 and/or the elastic developing roller 10 and a thickness of a developer layer is regulated.

Developing bias DC voltage of −350 V is applied to the elastic developing roller 10 from the developing bias voltage power source 13. By the developing bias DC voltage and an electric field formed from the potential on the photosensitive drum 1, in the vicinity of an abut portion (nip portion) between the photosensitive drum 1 and the elastic developing roller 10, the electrified toner is adhered to the image portion on the photosensitive drum 1, thereby visualizing the latent image.

On the other hand, the toner which was not consumed in the developing station and is remaining on the elastic developing roller 10 is returned to the interior of the developing device 4 together with the elastic developing roller 10 as the elastic developing roller 10 is rotated. At the abut area between the elastic developing roller 10 and the peeling roller 11, the developer on the elastic developing roller 10 is peeled by the sliding contact between the elastic developing roller 10 and the peeling roller 11 and is collected into the developing device 4. At the same time, by the rotation of the peeling roller 11, new toner is supplied onto the elastic developing roller 10 and is carried again to the abut area between the regulating blade 12 and the elastic developing roller 10.

The toner image formed on the photosensitive drum 1 is transferred onto the transfer material 7 by the transferring device 5 to which positive polarity bias voltage is applied and which is disposed in a side opposite to the photosensitive drum 1 and the toner with respect to the transfer material 7.

Further, if there is a small amount of positively electrified transfer-residual toner on the photosensitive drum 1, such toner is returned to negative polarity by the sliding contact between the toner and the electrifying roller 20 in the electrifying nip, and, thus, the transfer-residual toner can be collected positively at the developing station. Incidentally, the drum 1 is electrified by the electrifying roller 20 and exposed by the exposing device 3 while carrying the transfer-residual toner on the photosensitive drum 1. In the developing station, due to the presence of the developing bias applied to the developing roller, at the same time when the transfer-residual toner is returned from the dark portion of the drum 1 to the developing roller, the toner is supplied from the developing roller to the light portion of the drum.

Now, the photosensitive drum 1 will be fully described with reference to FIG. 2.

Figure 2:
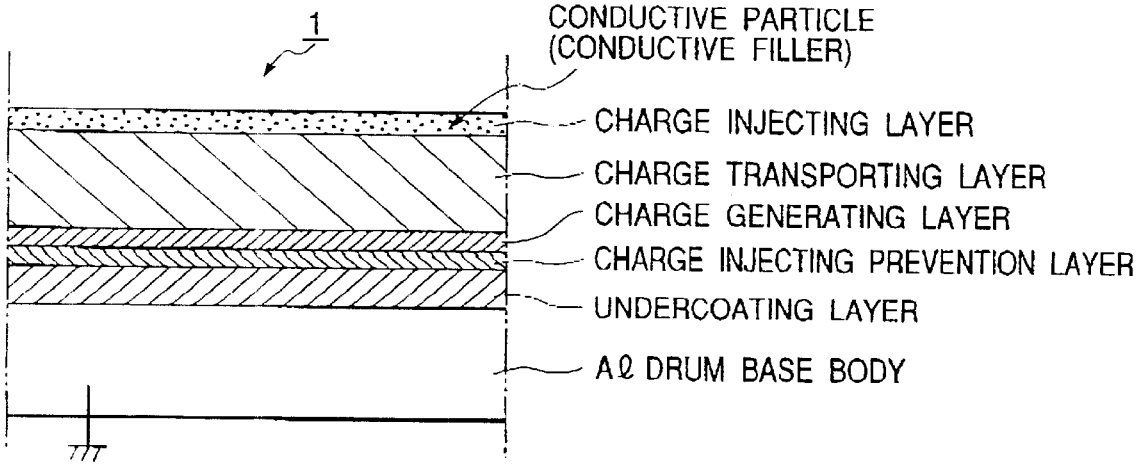
FIG. 2 is a partial sectional view showing a schematic construction of a latent image bearing member of the image forming apparatus of FIG. 1.

In the illustrated embodiment, as shown in FIG. 2, a charge injecting layer is coated on a general organic photosensitive body in which an undercoating layer, a charge injecting prevention layer, a charge generating layer and a charge transporting layer are successively coated on an aluminium base substrate in a superimposed fashion. The charge injecting layer is formed by mixing and dispersing $SnO_2$ super-fine particles as conductive particles (having a diameter of about 0.03 $\mu$m), lubricating agent such as Teflon and polymerization starting agent into acrylic resin of photo-curable type and thereafter (after coating) by effecting film-formation by means of a photo-curing method.

In the photosensitive drum used in the illustrated embodiment, since charge injection is effected onto the surface layer from the electrifying roller 20, the transmission of charges can be effected efficiently by reducing resistance of the surface layer of the photosensitive drum 1. On the other hand, since it is necessary that the electrostatic latent image be maintained for a predetermined time period, a volume resistance value of the charge injecting layer is preferably within a range from $1\times10^{9}$ ($\Omega\cdot$cm) to $1\times10^{14}$ ($\Omega\cdot$cm). Further, even when the charge injecting layer as is in the illustrated embodiment is not provided, for example, if the charge transporting layer has a resistance value within the above-mentioned range, the similar effect can be achieved. Furthermore, even when an amorphous silicon photosensitive body having volume resistance (of surface layer) of about $10^{13}$ ($\Omega\cdot$cm) is used, the similar effect can be achieved.

Next, the toner in the illustrated embodiment will be explained.

In the illustrated embodiment, the toner has a spherical or cone shape and weight mean particle diameter is preferably 10 $\mu$m or less (more preferably, 4 $\mu$m to 8 $\mu$m). When the toner has the uniform shape, the amount of the transfer-residual toner can be reduced considerably and the toner can be prevented to be carried to the electrifying nip.

In the toner according to the illustrated embodiment, a value of shape coefficient SF-1 as index for spherical degree is preferably 100 to 160 and a value of shape coefficient SF-2 is preferably 100 to 140. The shape coefficient SF-1 and the shape coefficient SF-2 of the toner according to the illustrated embodiment are defined as values obtained by sampling 100 toner images magnified by 500 times by using FE-SEM (S-800) manufactured by HITACHI Co., Ltd. at random, by introducing image Information into an image analyzing device (Luzex 3) manufactured by Nicore Corporation, and by analyzing the information, and then by effecting calculation by using the following equations (1):

$$\text{SF-1}=\{(\text{MXLNG})^2/\text{AREA}\}\times(\pi/4)\times100$$

$$\text{SF-2}=\{(\text{PERI})^2/\text{AREA})\}\times(1/4\pi)\times100 \quad (1)$$

Where, AREA is a toner projection area, MXLNG is an absolute maximum length, and PERI is a peripheral length.

The shape coefficient SF-1 of the toner indicates degree of roundness of the toner particle, and, as the value thereof increased, the toner particle gradually becomes non-fixed from the sphere. The value SF-2 indicates degree of unevenness of the toner particle, and, as the value thereof increased, unevenness of the toner surface becomes more noticeable. Further, regarding the particle diameter of the powder, fluctuation coefficient A in number distribution shown in the following equation (2) is preferably 35% or less:

$$\text{fluctuation coefficient A}=(S/D_1)\times100 \quad (2)$$

In the above equation (2), S is a standard deviation value in the number distribution of the powder particles and $D_1$ is a number mean particle diameter (mean particle diameter by weight: $\mu$m) of the powder particles. As the fluctuation coefficient (A) in the number distribution of the powder is increased, a width of particle diameter distribution is widened, and, if the fluctuation coefficient (A) in the number distribution is smaller than 35%, the transfer-residual toner is remaining on the photosensitive drum, thereby contaminating the electrifying roller. Further, if there is much toner which cannot be held by the electrifying roller, the exposure of the photosensitive drum will be blocked and, with the result that the desired latent image may not be formed.

Further, if weight mean particle diameter (mean particle diameter by number) is below 4 μm, since a reflection force (or mirroring force) is increased to reduce transferring efficiency, a number of transfer-residual toner particles on the photosensitive drum increases; whereas, if the weight mean particle diameter is greater than 10 μm, when fine dots are visualized, the latent image may not be reproduced.

In the illustrated embodiment, regarding the toner, the value SF-1 is selected to 130, the value SF-2 is selected to 120, the weight means particle diameter is selected to about 7 μm and the fluctuation coefficient in the number distribution is selected to 20%.

Next, the electrifying roller 20 will be fully described.

In the illustrated embodiment, and elastic roller having a diameter of 12 mm and Asker C hardness of 30° and constituted by coating an elastic layer made of continuous foam material on a metal core (electrode) made of stainless steel and having a diameter of 6 mm was used. Further, the electrifying nip was selected to 4 mm. The elastic layer is formed by heating an urethane layer obtained by uniformly dispersing conductive compounding agent such as foaming agent and carbon black thereby to achieve vulcanization and foaming and thereafter by polishing a surface if necessary.

The electrifying roller must be contacted with the photosensitive drum sufficiently to electrify the surface of the photosensitive drum. In order to obtain the sufficient contact between the photosensitive drum and the electrifying roller, it is preferable that the abut area between the photosensitive drum and the electrifying roller is constituted by an elastic body such as a rubber layer or a foam layer. However, if the hardness is too small, since the shape of the electrifying roller becomes unstable, the given contacting condition is not always obtained; whereas, if the hardness is too great, the electrifying nip may not be maintained well or torque is increased. Thus, the elastic body preferably has Asker C hardness of 25° to 50°.

The material of the electrifying roller is not particularly limited and may be obtained by dispersing conductive substance such as carbon black or metal oxide into rubber (generally used) such as EPDM, urethane, NBR, silicone rubber or IR. Further, in place of the fact that the conductive substance is dispersed, ion conductive elastic layer may be used.

Further, it is desirable that the electrifying roller is rotated with a speed difference with respect to the photosensitive drum at the abut area therebetween and that the electrifying roller is rotated, at the electrifying nip, in a counter direction opposite to the rotational direction of the photosensitive drum. The reason is that, sufficient contact chance between the photosensitive drum and the electrifying roller must be maintained in order to uniformly the photosensitive drum at the electrifying nip.

Further, when the photosensitive drum and the electrifying roller are rotated with the speed difference therebetween, even if the transfer-residual toner or any toner remaining on the photosensitive drum upon occurrence of sheet jam reaches the electrifying nip, the transfer-residual toner is returned to negative polarity by frictional agitation at the nip and the previous image pattern can be made even.

Next, the elastic developing roller 10 will be fully described.

In the illustrated embodiment, an elastic roller having a total diameter of 16 mm and obtained by molding an elastic body on a conductive metal core (electrode) having a diameter of 8 mm and made of stainless steel was used. The elastic body includes has a two-layer structure comprised of an undercoating layer obtained by dispersing carbon black into silicone rubber and a surface layer made of polyamide resin and having a thickness of about 10 μm and has Asker C hardness of about 350° and dynamic coefficient of friction of about 0.1. The developing nip was selected to 2 mm.

The hardness of the developing roller is desirably 25° to 50°. If the hardness is too small, since the shape of the developing roller becomes unstable, the given contacting condition is not always obtained, thereby causing uneven toner carrying amount. On the other hand, if the hardness is too great, the developing nip cannot be maintained well or deterioration of the toner will be promoted at the developing nip.

Further, surface roughness of the elastic developing roller 10 relates to the particle diameter of the toner used. In case of the toner particle diameter of 7 μm (weight mean particle diameter), ten-point mean roughness Rz of 3 to 15 μm is desirable. If the roughness is smaller than 3 μm, the adequate toner carrying force cannot be obtained; whereas, if the roughness is greater than 15 μm, when the latent image on the photosensitive drum 1 is visualized as the toner image, unevenness on the elastic developing roller 10 may affect an influence upon the image quality.

Further, dynamic coefficient $\mu$ of friction of the surface of the elastic developing roller 10 is preferably 0.02 to 0.8 and more preferably 0.02 to 0.4 (obtained by the following measuring method). If the dynamic coefficient of friction is too great, there will arise various problems such as excessive electrification or poor peeling; whereas, if the dynamic coefficient of friction is too small, the toner carrying amount becomes insufficient. The measuring method for the dynamic coefficient of friction is a method for measuring the surface of the elastic developing roller 10 by using a stainless thin plate. The reason for measuring the dynamic coefficient of friction of the surface of the elastic developing roller 10 contacted with stainless thin plate is that, since the photosensitive drum 1 utilizes the photosensitive layer having a thickness of several tens of μm coated on the aluminium substrate and the stainless metal plate is used as the regulating blade in the illustrated embodiment, it is considered that the dynamic coefficient of friction of the surface of the elastic developing roller 10 with respect to the stainless thin plate is proper in comparison with the actual condition. A measuring device is shown in FIG. 3. The stainless thin plate having a thickness of 0.03 mm and having one end connected to a weight W1 of 100 grams and the other end connected to a digital force gauge (which is adjusted to zero value when the weight W1 and the stainless thin plate are not loaded) is set on the surface of the elastic developing roller 10 so that an angle Θ shown in FIG. 3 becomes 45°.

The elastic developing roller 10 is rotated in a direction shown by the arrow R, and a sliding force between the elastic developing roller 10 and the stainless thin plate in this case is measured by the digital force gauge. An analogue output measured value is sampled with frequency of 10 Hz, and the data is calculated by using the following equation (3) to obtain the dynamic coefficient of friction. Further, calculation values during one revolution of the elastic developing roller 10 is averaged to seek the real measured value:

$$\mu=(1/\Theta)\ \ln\ (F/W) \tag{3}$$

In the above equation (3), $\mu$ is dynamic coefficient of friction, Θ is the angle shown In FIG. 3, W is the sum of W1 and W2, W1 is a weight of the weight, W2 is a weight of the stainless thin plate, and F is a measurement value of the digital force gauge.

The elastic body is not particularly limited to the two-layer structure but may have a single layer or three or more layers. Further, similar to the electrifying roller, the material of the elastic body is not particularly limited but may be rubber or resin generally used.

Next, the resistance values in the electrifying nip and the developing nip will be explained.

In order to sufficiently electrify the photosensitive drum in the electrifying nip and to prevent re-electrify the electrostatic latent image due to injection charges at the developing nip, great influence of resistance between the electrifying roller and the photosensitive drum and resistance between the developing roller and the photosensitive drum is subjected. It is preferable that at least an actual resistance value between the metal core of the developing roller carrying the toner and the toner layer is greater than that between the metal core of the electrifying roller and the surface of the photosensitive drum. Here, the reason why the actual resistance value is used as a condition of resistance value is that, if the resistance value is defined by volume resistance, the resistance values between the rollers and the photosensitive drum are varied in dependence upon the roller diameters and/or thickness of the toner layer. It is preferable that a first resistance value between the metal core of the electrifying roller and the surface of the drum is set to electrify the drum surface effectively, and a second resistance value between the metal core of the developing roller and the toner layer is set to be greater than the first resistance value in order to prevent the electrification of the drum surface.

Now, a method for measuring the actual resistance values of the electrifying roller and the developing roller in the present invention will be described.

In case of the electrifying roller, the electrifying roller is closely urged against an aluminum drum (having a diameter of 30 mm in the illustrated embodiment) having the same diameter as that of the used photosensitive drum to apply load (total pressure of 1 kg in the illustrated embodiment) onto the electrifying roller during the image formation. The aluminium drum is rotated at a peripheral speed of 100 mm/sec and the electrifying roller is rotated at a speed of 50 mm/sec in the counter direction (at the electrifying nip), and voltage (−600 V in the illustrated embodiment) is actually applied to the electrifying roller, and a resistance value (referred to as "resistance value of electrifying nip") between the electrifying roller and the aluminium drum is measured.

In case of the developing roller, the developing roller carrying the toner having the same amount as that in the image formation is urged against a surface of an aluminium drum (having a diameter of 30 mm in the illustrated embodiment) having the same diameter as that of the used photosensitive drum. Then, the developing roller is closely urged against the aluminium drum to apply load (total pressure of 1.5 kg in the illustrated embodiment) onto the developing roller during the image formation. The aluminium drum is rotated at a peripheral speed of 100 mm/sec and the developing roller is rotated at a speed of 150 mm/sec in the same direction (at the electrifying nip), and voltage (−350 V in the illustrated embodiment) is actually applied to the developing roller, and a resistance value (referred to as "resistance value of developing nip") between the developing roller and the aluminium drum is measured.

Namely, the same condition as the illustrated embodiment is used except that the photosensitive drum is replaced by the similar type aluminium drum.

By changing conditions of the resistance values in the above-mentioned measuring methods for the electrifying roller and the developing roller, the electrifying condition and the developing condition during the actual image formation were evaluated. Test results are shown in FIG. 4.

In a case where the resistance value of the electrifying nip is greater than $1\times10^5$ Ω, even when the voltage of −600 V was applied to the metal core of the electrifying roller, the surface potential of the photosensitive drum at the exposed position was −570 V thereby to cause the poor electrification (Δ in FIG. 4). Further, there was the tendency that the greater the residence value the smaller the surface potential of the photosensitive drum. To the contrary, when the resistance value of the electrifying nip was smaller than $1\times10^4$ Ω, the surface potential of the photosensitive drum at the exposing position could be electrified to about −600 V. The reason is that, if the resistance value of the electrifying nip is great, adequate electrification cannot be achieved for short electrifying nip passing time (about several 10 msec in the illustrated embodiment).

Further, when the resistance value of the developing nip was smaller than $1\times10^6$ Ω, the surface potential of the photosensitive drum after passing the developing nip was changed from the previous one (▲ in FIG. 4); whereas, when the resistance value of the developing nip was greater than $1\times10^7$ Ω, the surface potentials of the photosensitive drum before and after the developing nip were not changed. The reason is that, if the resistance value is small, the photosensitive drum is re-electrified during the developing nip passing time (about several 10 msec in the illustrated embodiment).

After all, a range capable of preventing the poor electrification in the image formation and preventing the re-electrification in the developing nip is defined by the fact that the resistance value between the electrifying roller and the aluminium drum is smaller than $10^5$ (Ω) and the resistance value between the developing roller and the aluminium drum is greater than $10^7$ (Ω) in the above-mentioned measuring method.

In the illustrated embodiment, by setting the resistance values between the electrifying roller/developing roller and the aluminium drum to be included within the above-mentioned range, since not only the poor electrification and re-electrification in the developing nip can be prevented but also generation of ozone due to discharging can be prevented, it is useful for the environmental problem which has recently been noticed.

In addition, since electrification, development and transferring which require high voltage bias can be effected by using DC power supplies, the power supplies can be made compact.

Further, since the developing roller abuts against the photosensitive drum, the toner positively electrified in the electrifying nip can be collected simultaneously with the developing, with the result that any cleaner can be omitted. Further, in the contact developing system, since a distance between the developing electrode and the electrostatic latent image is short, high quality image output corresponding to the latent image can be obtained.

As mentioned above, according to the illustrated embodiment, an image forming apparatus which can achieve high quality image output and which can be made compact and simplified and adapt to the environment can be provided.

Second Embodiment

Next, a second embodiment of the present invention will be explained. Incidentally, similar elements to those in the first embodiment are designated by the same reference numerals and explanation thereof will be omitted.

In the second embodiment, there is provided an image forming apparatus in which electrification promoting particles are disposed between the electrifying roller and the photosensitive drum in order to effect more stable electrification by means of the electrifying nip.

Figure 5:
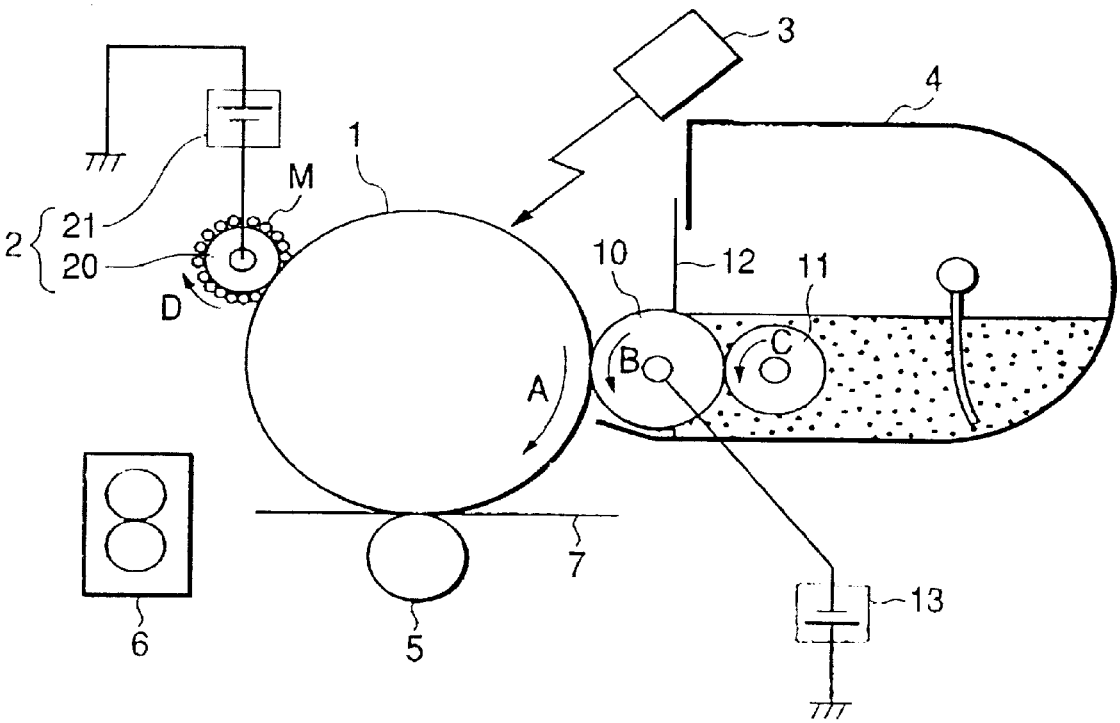
FIG. 5 is a sectional view showing a schematic construction of an image forming apparatus according to a second embodiment of the present invention.
Figure 6:
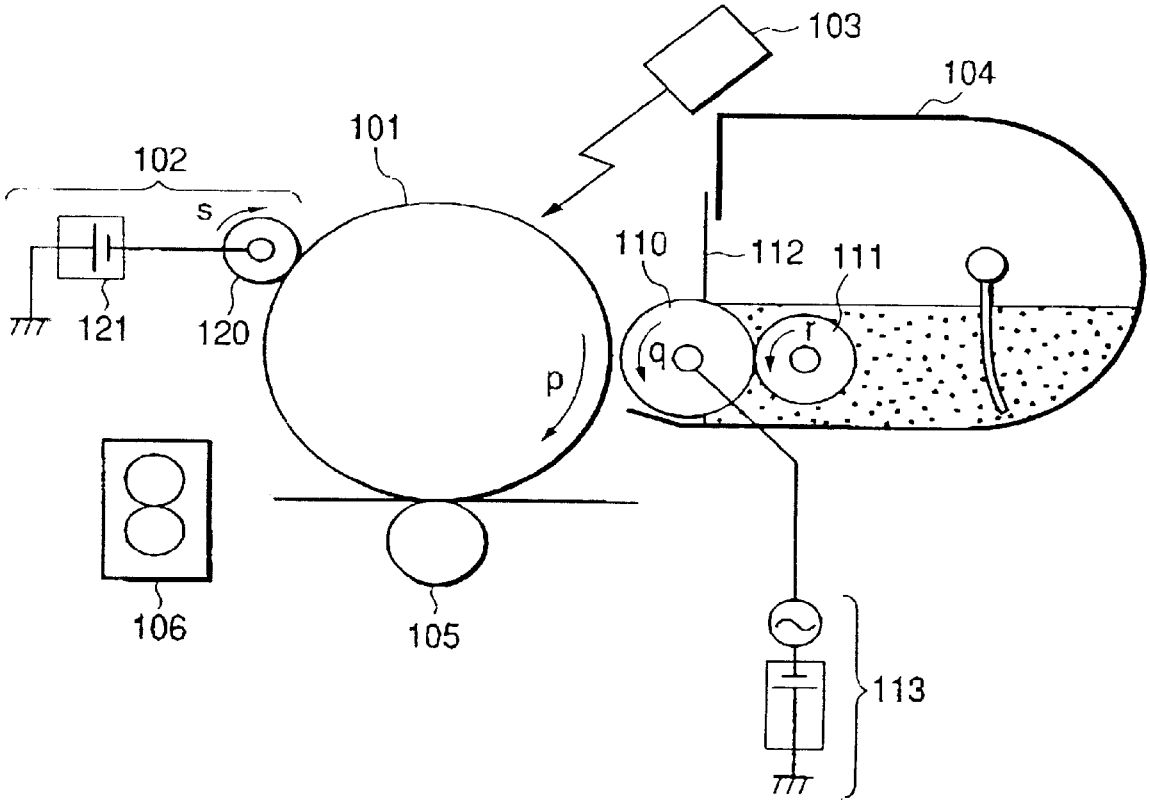
FIG. 6 is a sectional view showing a schematic construction of a conventional image forming apparatus.

FIG. 5 is a sectional view showing a schematic construction of the image forming apparatus according to the second embodiment.

The second embodiment is characterized in that conductive electrification promoting particles exist between the electrifying roller 20 and the photosensitive drum 1. When the electrification promoting particles exist in the electrifying nip, since contacting ability between the electrifying roller 20 and the photosensitive drum 1 is enhanced, minute unevenness and/or resistance unevenness of the electrifying roller 20 can be suppressed in comparison with a case where there is no electrification promoting particle in the electrifying nip, thereby electrifying the photosensitive drum 1 more uniformly. Further, by providing the electrification promoting particles in the electrifying nip, rotational torques of the photosensitive drum 1 and the electrifying roller 20 which are rotated with speed difference can be reduced.

In the illustrated embodiment, in order to supply the electrification promoting particles into the electrifying nip, the electrification promoting particles are previously coated on the electrifying roller 20, and, thereafter, the particles is gradually supplied onto the photosensitive drum 1 from the developing device 4 by externally adding the electrification promoting particles to the toner.

When the image portion on the photosensitive drum 1 is developed by the elastic developing sleeve 10, the electrification promoting particles externally added to the toner are adhered to the photosensitive drum 1 together with the toner. Further, the weak-positively electrified electrification promoting particles are also adhered to the nonimage portion on the photosensitive drum 1 by an influence of an electric field. (As will be described later, since some of the electrification promoting particles are formed from metal oxide, they may be conductive or weal-positively electrified by friction in the electrifying nip and the developing nip.) Namely, the electrification promoting particles are always supplied onto the photosensitive drum 1 little by little.

Upon reaching to the transferring station, the negatively electrified toner is positively transferred onto the transfer material by the electric field. On the other hand, although the conductive or weal-positively electrified electrification promoting particles are not positively transferred onto the transfer material by the electric field, a very small amount of the particles is physically adhered to the transfer material by unevenness on the surface of the transfer material and/or adhering ability.

After the transferring, when the electrification promoting particles remaining on the photosensitive drum 1 reach the electrifying nip, the particles are used for electrifying the surface of the photosensitive drum. The excessive particles, which are not held by the electrifying roller 20 adhere to the photosensitive drum 1 and are passed through the electrifying nip and the exposing portion and reach the developing nip. The electrification promoting particles carried to the developing nip are collected in the developing nip at an area corresponding to the image portion of the photosensitive drum 1 and are passed through the developing nip at an area corresponding to the nonimage portion of the photosensitive drum 1. The latter particles are carried through the transferring portion and the electrifying portion again.

Further, even if a small amount of the positively electrified transfer-residual toner is remaining on the photosensitive drum 1, such toner is returned to the negative polarity while it is being mixed with the electrification promoting particles in the electrifying nip, with the result that such toner can positively be collected in the developing portion.

Next, in the illustrated embodiment, the electrification promoting particles having an important role will be fully described.

In the illustrated embodiment, as the electrification promoting particles previously coated on the electrifying roller 20 and externally added to the toner in the developing device 4, conductive zinc oxide particles having specific resistance of $10^7$ (Ω·cm) and mean particle diameter of 1.5 μm are used. Although the electrification promoting particles exist not only in a primary particulate condition but also in a condition in which secondary particules are aggregated, there is no particular problem. Incidentally, if the particles are aggregated, the particle diameter is defined as mean particle diameter of aggregation.

In the measurement of the particle diameter, 100 or more particles are sampled by using an optical or electronic microscope, and volume grain distribution is calculated on the basis of a horizontal maximum length, and the particle diameter is determined by 50% mean particle diameter.

The resistance value is measured by a tablet method and is sought by normalization. That is to say, powder specimen of about 0.5 gram is housed in a cylinder having a bottom area of 2.26 $cm^2$, and a resistance value of the specimen is measured by applying pressure of 15 kg to upper and lower electrodes and applying voltage of 100 V to the electrodes, and, thereafter, the resistivity is calculated by normalizing the measured value. The specific resistance value in the present invention is smaller than $10^{12}$ (Ω·cm) to obtain adequate electrifying ability, and preferably smaller than $10^{10}$ (Ω·cm).

Further, the electrification promoting particles are preferably transparent or white so as not to prevent the exposure. Further, in consideration of the fact that part of the electrification promoting particles on the photosensitive drum may adhere to the transfer material during the transferring, the electrification promoting particles are desirably transparent or white.

In the illustrated embodiment, while an example that the zinc oxide is used was explained, the present invention is not limited to such an example, but, various conductive particles such as conductive inorganic particles made of metal oxide such as alumina or mixture with organic substance or surface-treated particles. Particularly, since many of metal oxides are white, they can be used easily.

Further, the number of the electrification promoting particles in the electrifying nip is desirably 500 to 500000/$mm^2$ on the photosensitive drum. According to the Inventor's test, it was found that, when such number is smaller than 500/$mm^2$, contact unevenness in the electrifying nip becomes noticeable to cause a poor image, and, when such number is greater than 500000/$mm^2$, the particles on the photosensitive drum become excessive, thereby causing a poor exposure amount and/or exposure trouble.

By using the same construction as the illustrated embodiment except that the conditions of the actual resistance value of the electrifying nip and the actual resistance value of the developing nip are changed, the electrifying condition and the developing condition during the actual image formation are evaluated by using the measuring method explained in connection with the first embodiment. As a result, the same result as the first embodiment was obtained. That is to say, when the resistance value of the electrifying nip is greater than $1\times10^5$ Ω, poor electrification occurred, and, when the resistance value of the developing nip is smaller than $1\times10^6$ Ω, the re-electrification occurred in the developing nip thereby to distort the electrostatic latent image. It was found that, when the resistance value of the electrifying nip is below $1\times10^5$ Ω and the resistance value of the developing nip is greater than $1\times10^7$ Ω, no problem arise in the electrifying portion and the developing portion.

As mentioned above, according to the illustrated embodiment, even when the electrification promoting particles exist in the electrifying nip and the developing nip, by setting the resistance value of the electrifying nip and the resistance value of the developing nip to the above-mentioned conditions, poor electrification and re-electrification in the developing nip can be prevented. Further, more uniform electrification can be achieved and the torque can be reduced.

Incidentally, in the illustrated embodiment, it is desirable that for holding adequate electrification promoting particles in the electrifying nip, microscopic unevenness is provided on the surface of the electrifying roller. Foam sponge capable of reducing the hardness is particularly suitable.

Further, the supplying method for supplying the electrification promoting particles to the electrifying nip is not limited to the illustrated embodiment. For example, a block made of the electrification promoting particles may be urged against the electrifying roller to supply the particles to the roller by gradually scraping the block as the electrifying roller is rotated.

In addition, in the illustrated embodiment, while the cleanerless image forming apparatus was explained, the present invention can be applied to an image forming apparatus having a cleaner. Even when electrification promoting particles are used, since the electrification promoting particle has a particle diameter smaller than the toner particle, some of the electrification promoting particles can pass through between the cleaning member and the photosensitive drum to be supplied to the electrifying nip.

Further, in the illustrated embodiment, while different material and structure were used between the electrifying roller and the developing roller, so long as the above-mentioned conditions such as particle carrying performance and voltage dependency of the resistance are satisfied, the same type of rollers may be used.

Further, in the illustrated embodiment, while an example that the negative polarity reversal contact developing system is used was explained, the similar or same effect can be achieved in a normal developing system and a positive polarity reversal developing system.

As mentioned above, in the image forming apparatus utilizing the contact electrifying and contact developing system, the latent image bearing member can be prevented from being re-electrified in the developing nip, and cleaning simultaneous with developing can be effected, and high quality image formation can be effected.

What is claimed is:

1. An image forming apparatus comprising:

an image bearing member;

electrostatic image forming means adapted to form an electrostatic image on said image bearing member and including an electrifying member contacted with said image bearing member to electrify said image bearing member, said electrifying member including a first conductive member to which an electrifying voltage is applied, said electrifying member performing an injecting charge to said image bearing member; and a developer carrying member cooperating with said image bearing member to form a nip therebetween and adapted to carry developer to said nip and to develop the electrostatic image with the developer and having a second conductive member to which voltage is applied; and wherein a resistance value between said second conductive member and a developer layer of the developer carried on said developer carrying member is greater than a resistance value between said first conductive member and a surface of said image bearing member, and a peripheral speed difference between said developer carrying member and said image bearing member is smaller than a peripheral speed difference between said electrifying member and said image bearing member.

2. An image forming apparatus according to claim 1, wherein said electrifying member includes an elastic body covering said first conductive member.

3. An image forming apparatus according to claim 2, wherein said first conductive member includes a metal core.

4. An image forming apparatus according to claim 1, wherein said developer carrying member includes an elastic body covering said second conductive member.

5. An image forming apparatus according to claim 4, wherein said second conductive member includes a metal core.

6. An image forming apparatus according to claim 1, wherein the resistance value between said second conductive member and the developer layer is not smaller than $10^7$ Ω.

7. An image forming apparatus according to claim 6, wherein the resistance value between said first conductive member and said surface of said image bearing member is smaller than $10^5$ Ω.

8. An image forming apparatus according to either claim 1 or 6, wherein the voltage applied to said second conductive member is a DC voltage.

9. An image forming apparatus according to claim 1 or 6, wherein said developer carrying member can effect a developing operation and simultaneously can clean the developer from said image bearing member.

10. An image forming apparatus according to claim 1 or 7, wherein said electrifying member includes an elastic body for forming an electrifying nip between said electrifying member and said image bearing member, and conductive particles are provided in said electrifying nip, and the resistance value between said first conductive member and said surface of said image bearing member is a resistance value between said first conductive member and a particle layer of said conductive particles.

11. An image forming apparatus according to claim 10, wherein a resistance value of said particle layer of said conductive particles is smaller than $10^{12}$ Ω.

12. An image forming apparatus according to claim 10, wherein said developer carrying member can carry said conductive particles, and said conductive particles are supplied from said developer carrying member to said image bearing member.

13. An image forming apparatus according to claim 1, wherein said image bearing member includes a surface layer having a volume resistance of $1\times10^9$ to $1\times10^{14}$ Ω·cm.

14. An image forming apparatus according to claim 1, wherein the developer has a SF-1 of 100 to 160 and a SF-2 of 100 to 140.

15. An image forming apparatus according to claim 1, wherein said electrifying member moves in a reverse direction relative to a movement direction of said image bearing member in a contact portion between said electrifying member and said image bearing member.

16. An image forming apparatus according to either claim 1 or 15, wherein said developer carrying member moves in a same direction as a movement direction of said image bearing member in said nip between said developer carrying member and said image bearing member.

17. An image forming apparatus according to claim 16, wherein a peripheral speed of said developer carrying member is greater than a peripheral speed of said image bearing member.

* * * * *

UNITED STATES PATENT AND TRADEMARK OFFICE

CERTIFICATE OF CORRECTION

PATENT NO. : 6,564,027 B2
DATED : May 13, 2003
INVENTOR(S) : Manami Haraguchi et al.

It is certified that error appears in the above-identified patent and that said Letters Patent is hereby corrected as shown below:

Column 4,
Line 10, "constriction" should read -- construction --.

Column 6,
Line 39, "Information" should read -- information --.

Column 7,
Line 26, "an" should read -- a --; and
Line 57, "to" should read -- to electrify --.

Column 8,
Line 4, "has a" should read -- a --.

Column 11,
Line 27, "is" should read -- are --.

Signed and Sealed this

Eleventh Day of November, 2003

JAMES E. ROGAN
*Director of the United States Patent and Trademark Office*